United States Patent [19]

McKay

[11] 4,191,233

[45] Mar. 4, 1980

[54] SKI COVERS

[76] Inventor: Gordon McKay, 2326 Albert Ave., Saskatoon, Saskatchewan, Canada

[21] Appl. No.: 959,234

[22] Filed: Nov. 9, 1978

[51] Int. Cl.[2] ..... B65D 81/00; A63C 11/00

[52] U.S. Cl. ..... 150/52 R; 150/3; 280/11.37 K

[58] Field of Search ..... 150/52 R, 3; 280/11.37 K, 11.37 R, 11.38; 224/45 S, 8 R

[56] References Cited

U.S. PATENT DOCUMENTS

| | | | |
|---|---|---|---|
| 3,245,448 | 4/1966 | Rea | 150/52 R |
| 3,336,961 | 8/1967 | Welsh | 150/52 R |
| 3,909,031 | 9/1975 | Schmaedeke et al. | 280/11.37 K |
| 4,006,912 | 2/1977 | Perlich et al. | 280/11.38 |

*Primary Examiner*—George T. Hall

*Attorney, Agent, or Firm*—Stanley G. Ade

[57] ABSTRACT

Individual covers are provided for each ski with detachable top covers so that a limited adjustment for ski length is provided. Each cover has a web portion substantially centrally located by which means the two covers can be detachably secured together by means such as a slide fastener. Alternatively, each web can be secured by slide fastener to a tote bag depending therebetween. Straps are provided to detachably secure the ends of the ski covers together and straps are provided to enable the package to be carried easily in one hand. A pocket on each cover receives the ski pole handles. The skis can be carried joined together by the web, joined to a tote bag or the covers can be separated to enable the skis to be carried on a conventional car ski rack or the like.

16 Claims, 6 Drawing Figures

SKI COVERS

BACKGROUND OF THE INVENTION

This invention relates to new and useful improvements in ski covers.

Many attempts have been made to provide ski covers in which a pair of covers is joined together and examples of such patents covering this construction include U.S. Pat. Nos. 2,180,686; 2,250,388; 3,245,448; 3,336,961; 3,948,302; 3,851,689.

However, these and other inventions of this nature suffer from one principal disadvantage. While it is convenient to carry a pair of skis within a cover assembly which is a one-piece assembly for a pair of skis, nevertheless these covers are not usable when it is desired to attach the skis to a conventional ski rack on the back of an automobile or the like.

The spacing of such ski racks is far too wide to enable the cover assembly to span the distance between adjacent ski racks and of course, the racks are such that they will not take a pair of skis but only one ski in each receptacle of the rack.

SUMMARY OF THE INVENTION

The present invention overcomes these disadvantages by providing a structure which has the advantages of cover assemblies which may be detachably secured together for convenience of manual transportation yet at the same time may be separated so that each ski can be readily secured within the relevant portion of any conventional ski rack normally found on atuomobiles and the like.

A further advantage flowing from the detachability of the cover assemblies is the fact that, if desired, a storage bag may be suspended between a pair of covers and secured thereto so that boots or other clothing may readily be carried manually if desired.

The invention is characterized by the provision of a pair of individual flexible and detachable cover assemblies, one each for each ski of a pair of skis, a web portion extending from each of said cover assemblies intermediate the ends thereof and fastening means for detachably securing said web portions together and hence said ski cover assemblies together.

Another aspect of the invention is to provide a device of the character herewithin described which may include a pocket on at least one of the cover assemblies adapted to receive the handles of the associated ski poles so that the ski poles can readily be strapped to the cover assembly so that the entire unit can readily be carried as a single package.

Another aspect of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 1:
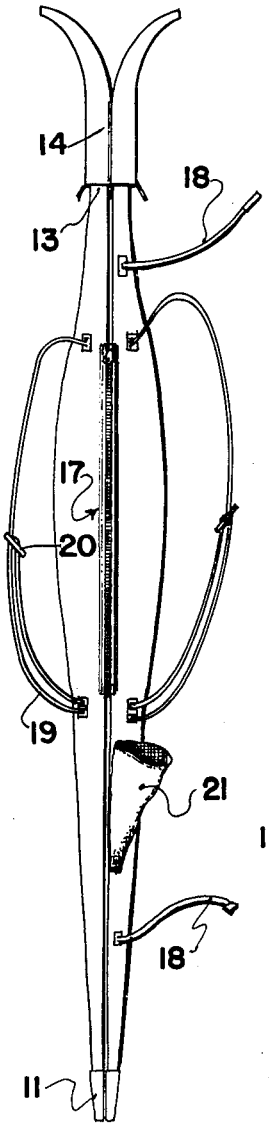
FIG. 1 is a plan view of a pair of cover assemblies secured together and turned back to back for ease of carrying.

Proceeding therefore to describe the invention in detail, reference character 10 illustrates one ski bag or cover assembly which is manufactured from any desired material and is provided with a closed lower end 11 and an elongated fastener assembly such as a slide fastener 12, extending from the closed end 11 or the other or open end 13. When this slide fastener is opened, a conventional ski (not illustrated) is readily inserted within the cover assembly which may then be closed by means of the sliding assembly 12 leaving the tip of the ski exposed. This tip area is covered with a removable tip cover 14 which slips over the tip of the ski and is detachably secured to the main body of the cover assembly 10 by any convenient means such as a friction fastener known by the trade mark VELCRO and indicated by reference character 15. This gives a certain flexibility in the length of the cover assembly so that it can readily be adapted for use with skis of different lengths, within limits.

Figure 2:
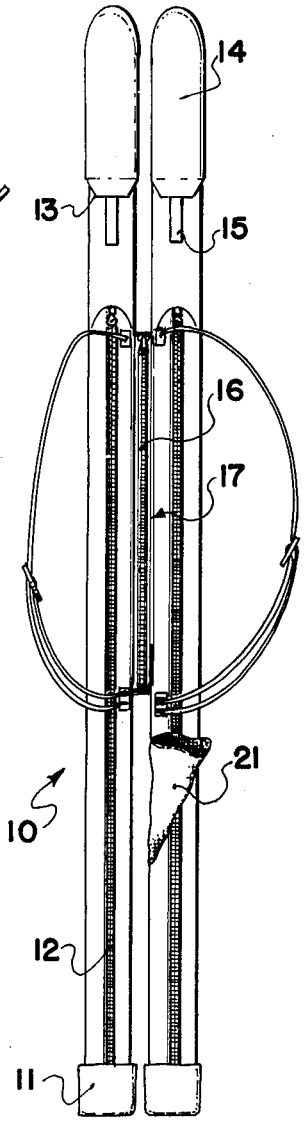
FIG. 2 is a view similar to FIG. 1, but showing the cover assemblies lying side by side.

There are two such cover assemblies 10 for a set, one each for each ski of a pair of skis and intermediate the ends of one side of the cover assembly, I have provided an elongated web or strip 16 together with one element of a slide fastener assembly collectively designated 17, it being understood that the complementary element of the slide fastener assembly is secured to the web 16A of the other cover assembly. This enables the two portions of the slide fastener assembly to be engaged together thus securing the two cover assemblies together intermediate the ends thereof and along a length defined by the length of the slide fastener assembly 17. The two cover assemblies so secured together, is illustrated in FIG. 2 and once secured together, the flexible web material together with the material of the cover assemblies, enables the two skis to be turned at right angles to one another so that the cover assemblies take up the position illustrated in FIG. 1.

Flexible strap means 18 are provided adjacent each end of the cover assemblies, on one of the cover assemblies which may be wrapped around the two cover assemblies together with the skis enclosed thereby, to secure the package together for easy manipulation.

Further flexible strap loops 19 are secured to the cover assemblies substantially in the location of the webs 16 and 16A and may be used as carrying handles, shoulder straps or the like, conventional length adjustment means 20 being provided to the strap loops.

It will also be noted that a relatively small pocket 21 is provided on at least one of the cover assemblies rearwardly of the web 16A, said pockets being adapted to receive the handle ends of associated ski poles (not illustrated) with the ski poles lying substantially parallel to the cover assemblies and being secured thereto by means of one of the straps 18 as it is wrapped around the cover assemblies. This enables the entire package to be carried by one hand readily and easily, if desired.

Alternatively, it will be appreciated that by detaching the two cover assemblies, the skis contained therein together with the cover assembly is readily attachable to a conventional ski rack whether it be a side to side rack, bottom to bottom rack or a rack in which the components are completely separated.

Figure 3:
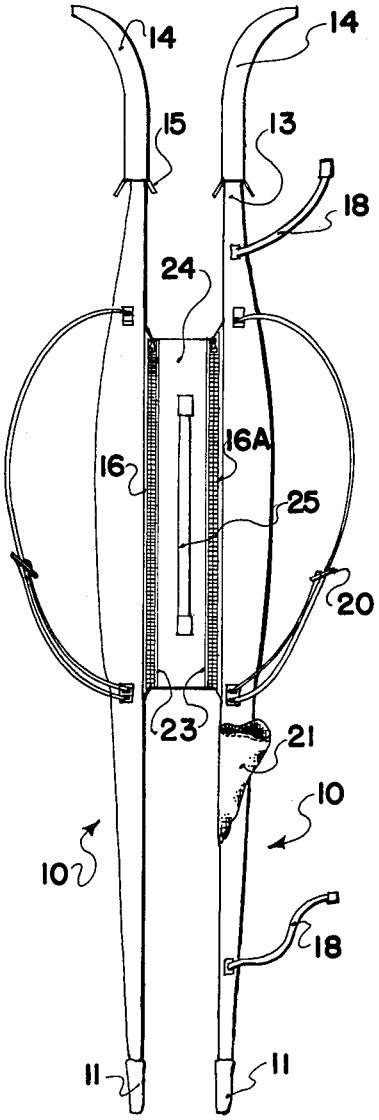
FIG. 3 is a view similar to FIG. 1, but showing a tote bag between the adjacent cover assemblies.
Figure 4:
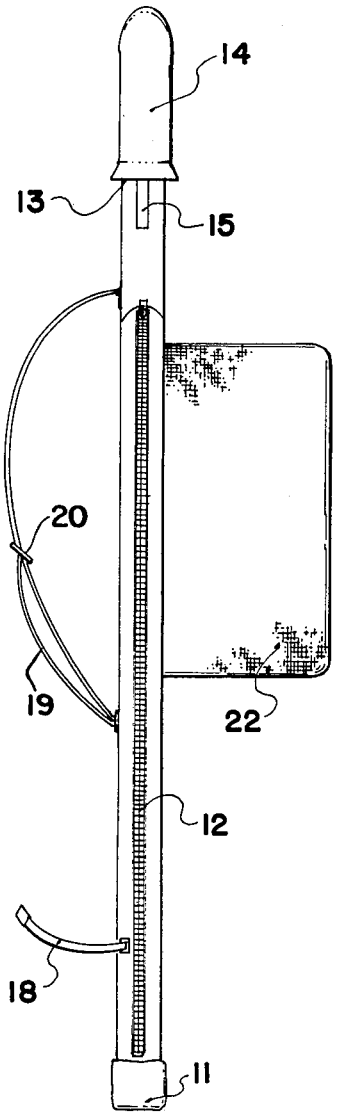
FIG. 4 is a view substantially at right angles to FIG. 3.

FIGS. 3 and 4 show a further embodiment of the device in which a flexible storage bag 22 is provided with complementary slide fastener grips 23, adjacent each side of the upper side or panel 24 thereof. Each of these slide fastener components is detachably engage by the corresponding slide fastener component on the webs 16 and 16A thus securing the pair of cover assemblies, one upon each side of the storage bag 22 as clearly shown in FIG. 3. A carrying handle 25 may be provided on the upper panel 24 as illustrated or alternatively, the shoulder strap loops 19 may be used for carrying purposes. This enables the skis, the ski poles and any associated equipment such as wax or the like, to be carried as a single package and in one hand.

Figure 5:
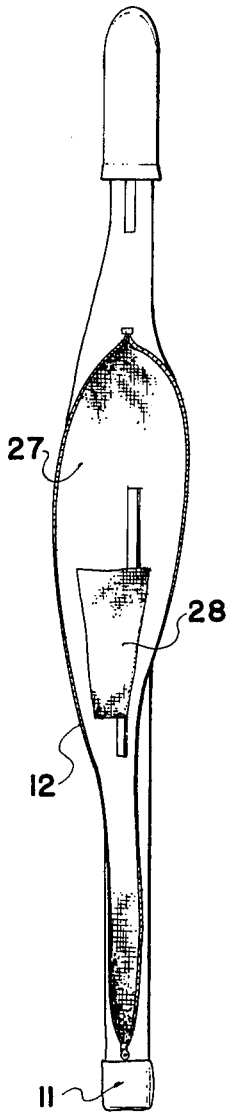
FIGS. 5 and 6 show a pair of cover assemblies separated from one another with the slide fasteners being shown in the open position and a storage bag detachably secured within one of the cover assemblies.
Figure 6:
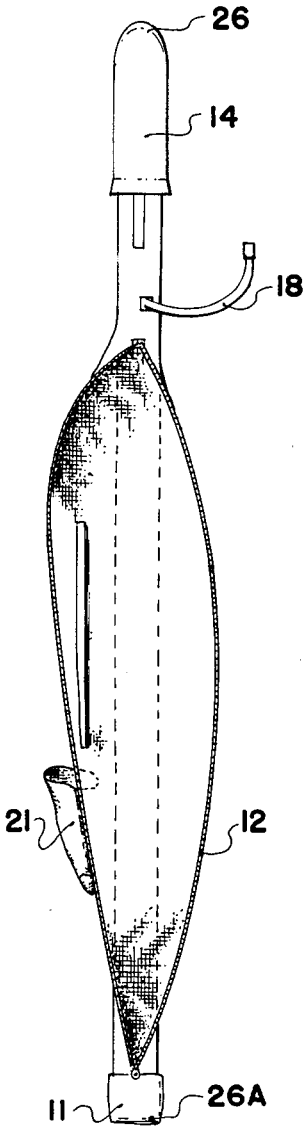

FIGS. 5 and 6 show additional details of the individual cover assemblies 10 including reinforcing material at the tips of the tip covers 14, illustrated by reference character 26, similar reinforcing material 26A at the lower or closed ends of the cover assemblies, it being understood that the necessary reinforcing material or strip 27 may be provided along the slide fastener assembly 12 on each side of the cover assembly. A relatively small, separate, flexible bag 28 may be secured as by the aforementioned VELCRO or the like, within the cover assemblies which can be detached so that the cover assemblies can be folded compactly and stored within this bag when the cover assemblies are removed from the skis.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A pair of individual flexible and detachable cover assemblies, one each for each ski of a pair of skis, a web portion extending from each of said cover assemblies intermediate the ends thereof and fastening means for detachably securing said web portions together and hence said ski cover assemblies together.

2. The invention according to claim 1 in which said web portion is elongated, said fastening means comprising a sliding fastener assembly, one portion of said sliding fastener assembly being on one of said web portions, the complementary portion of said sliding fastener assembly being on the other of said web portion.

3. The invention according to claim 1 which includes tip covers for said cover assemblies detachably securable to said cover assemblies for limited length adjustable relationship therewith.

4. The invention according to claim 2 which includes tip covers for said cover assemblies detachably securable to said cover assemblies for limited length adjustable relationship therewith.

5. The invention according to claim 1 which includes pocket means on at least one of said cover assemblies to receive the handles of the associated ski poles.

6. The invention according to claim 2 which includes pocket means on at least one of said cover assemblies to receive the handles of the associated ski poles.

7. The invention according to claim 3 which includes pocket means on at least one of said cover assemblies to receive the handles of the associated ski poles.

8. The invention according to claim 4 which includes pocket means on at least one of said cover assemblies to receive the handles of the associated ski poles.

9. The invention according to claim 1 together with storage bag means, means detachably securing said storage bag between said web portions of said pair of cover assemblies, said last mentioned means comprising complementary fastening means along each side of said storage bag means, detachably engageable with the corresponding fastener means on each of said web portions.

10. The invention according to claim 2 together with storage bag means, means detachably securing said storage bag between said web portions of said pair of cover assemblies, said last mentioned means comprising complementary fastening means along each side of said storage bag means, detachably engageable with the corresponding fastener means on each of said web portions.

11. The invention according to claim 3 together with storage bag means, means detachably securing said storage bag between said web portions of said pair of cover assemblies, said last mentioned means comprising complementary fastening means along each side of said storage bag means, detachably engageable with the corresponding fastener means on each of said web portions.

12. The invention according to claim 4 together with storage bag means, means detachably securing said storage bag between said web portions of said pair of cover assemblies, said last mentioned means comprising complementary fastening means along each side of said storage bag means, detachably engageable with the corresponding fastener means on each of said web portions.

13. The invention according to claim 5 together with storage bag means, means detachably securing said storage bag between said web portions of said pair of cover assemblies, said last mentioned means comprising complementary fastening means along each side of said storage bag means, detachably engageable with the corresponding fastener means on each of said web portions.

14. The invention according to claim 6 together with storage bag means, means detachably securing said storage bag between said web portions of said pair of cover assemblies, said last mentioned means comprising complementary fastening means along each side of said storage bag means, detachably engageable with the corresponding fastener means on each of said web portions.

15. The invention according to claim 7 together with storage bag means, means detachably securing said storage bag between said web portions of said pair of cover assemblies, said last mentioned means comprising complementary fastening means along each side of said storage bag means, detachably engageable with the corresponding fastener means on each of said web portions.

16. The invention according to claim 8 together with storage bag means, means detachably securing said storage bag between said web portions of said pair of cover assemblies, said last mentioned means comprising complementary fastening means along each side of said storage bag means, detachably engageable with the corresponding fastener means on each of said web portions.

* * * * *